United States Patent [19]

Hornberger

[11] 4,341,355

[45] Jul. 27, 1982

[54] ARRANGEMENT FOR SUPPORT OF CONTACT ELEMENTS FOR MATERIAL TREATING APPLICATIONS

[75] Inventor: Michael E. Hornberger, Carlisle, Pa.

[73] Assignee: The Frog, Switch & Manufacturing Company, Carlisle, Pa.

[21] Appl. No.: 129,830

[22] Filed: Mar. 13, 1980

[51] Int. Cl.[3] ..... B02C 17/22

[52] U.S. Cl. ..... 241/102; 241/183; 241/299; 241/DIG. 30

[58] Field of Search ..... 241/102, 181–183, 241/284, 291, 299, DIG. 30; 264/261

[56] References Cited

U.S. PATENT DOCUMENTS

| | | | |
|---|---|---|---|
| 1,179,696 | 4/1916 | Canda | 428/599 |
| 1,534,000 | 4/1925 | Baker | 241/183 |
| 1,872,036 | 8/1932 | Hardinge | 241/70 |
| 2,105,048 | 1/1938 | Lauenstein et al. | 148/3 |
| 2,155,215 | 4/1939 | Beament | 148/3 |
| 3,146,958 | 9/1964 | Wallace, Jr. | 241/15 |
| 3,235,190 | 2/1966 | Symons | 241/299 |
| 3,339,609 | 8/1967 | Cushman | 264/261 X |
| 3,462,090 | 8/1969 | Landes et al. | 241/299 |
| 3,680,799 | 8/1972 | Hallerbach | 241/183 |
| 3,934,828 | 1/1976 | Persson | 241/102 |
| 4,046,326 | 9/1977 | Larsen | 241/182 |
| 4,099,988 | 7/1978 | Horiuchi | 148/3 |
| 4,141,511 | 2/1979 | Anderson | 241/183 |
| 4,177,955 | 12/1979 | Miller | 241/183 |

*Primary Examiner*—Mark Rosenbaum
*Assistant Examiner*—Timothy V. Eley
*Attorney, Agent, or Firm*—Neuman, Williams, Anderson & Olson

[57] ABSTRACT

A method and arrangement for support of contact elements for material treating applications are disclosed in which a hardenable liquid bonding material is flowed into a space provided between surface areas of support and contact elements, the material being allowed to harden to provide a solid element which acts in compression to resiliently oppose relative movement of the elements. The space preferably has a cross-sectional configuration such that a wedging action is developed in response to relative movement of the elements. The holding element may be effectively burned out for removal and replacement of the contact element.

12 Claims, 4 Drawing Figures

ARRANGEMENT FOR SUPPORT OF CONTACT ELEMENTS FOR MATERIAL TREATING APPLICATIONS

This invention relates to methods and arrangements for support of contact elements for material treating applications and more particularly for applications in which the contact elements are subjected to severe wear and impact problems. The method and arrangement of the invention is such that the contact elements can be readily installed while being securely and reliably supported and they can also be readily removed.

BACKGROUND OF THE PRIOR ART

In various forms of apparatus for treating of materials and particularly in crushers, mills and the like for crushing and grinding rocks and other hard and highly abrasive materials, difficulties have been encountered with respect to the support of elements which contact the material. The contact elements are subjected to wear and should, therefore, be replaceable. At the same time, they must be very firmly and reliably supported and the requirements are quite severe in many cases because of the impact forces applied to the elements during operation.

Various types of support arrangements have been used, generally including a bolt or other mechanically operable securing device. Such arrangements, while being generally satisfactory in operation have made it difficult and time-consuming to install the contact elements and they have not been without problems. In some cases, the elements have become detached from the supports which can cause serious problems in the operation of some types of material treating apparatus. There has also been a problem with loosening of the elements and some attempts have been made to use a rubber material which is compressed during assembly and designed to adjust for dimension changes from changes in temperature or otherwise.

Certain inherent problems have not been fully recognized and dealt with in the prior art. It has not been generally recognized that localized stress concentrations are frequently developed when using bolts or similar types of securing devices to cause problems with respect to failures and loosening of the supports. When rubber or rubber-like materials are used, they are apt to lose their resiliency and thus fail to perform their intended function because of being held in a severely stressed condition.

SUMMARY OF THE INVENTION

This invention was evolved with the general object of overcoming problems of the prior art and of providing a method and arrangement for support of a contact element for material treating applications, such that the contact element is securely and reliably supported while being readily installed.

Another object of the invention is to provide a contact element support method and arrangement such that a contact element is resiliently supported with the energy of impact forces being absorbed to minimize loosening of the element and damage thereto.

In accordance with this invention, a contact element is moved to an installed position relative to a support element and a liquid hardenable bonding material is then flowed into a space between surface areas of the elements, the material being thereafter allowed to harden to provide a solid holding and locking element adhesively secured to the surface areas. The surface areas have a configuration such as to provide a first portion on the support element and a second surface portion on the contact element which so operate when the contact element is moved away from its installed position as to apply compressive forces to opposite side portions of the bonding element to compress the element therebetween. With this method and arrangement, an adhesive material is used to perform the functions performed by bolts, wedges and the like in prior arrangements. However, an adhesive bond is not relied upon exclusively to secure the elements together, the compressive strength of the hardened holding and locking element being operative to insure against separation of the elements even if the adhesive bond should fail.

The method and arrangement also have the advantage that they greatly reduce stresses which might tend to cause failure of the adhesive bond and hence render it unlikely that the bond would fail.

Another very important advantage is that the hardened holding and locking element can have a resiliency such that it can be compressed to a substantial extent and absorb energy of impact forces or the like applied to the contact element. By using a space having the appropriate volume and configuration, a support is provided which can absorb large energies while at the same time securely and reliably holding the contact element in place.

It will be appreciated that the installation of the contact element is easily, readily and quickly accomplished. At the same time, the contact element can be removed, as by heating the structure to a temperature high enough to effectively burn out the bonding element.

Additional features of the invention relate to the formation of the surface areas of the contact and support elements in a manner such that compressive strength properties of the holding and locking elements are used to maximum advantage while minimizing tensile and shearing stresses of the element. At the same time, the element can be used to maximum advantage in absorbing the energies of impacts and and it is also noteworthy that the element in its normal state is not stressed and is stressed only in response to forces applied during its operation.

This invention has other objects, features and advantages which will become more fully apparent from the following detailed description taken in conjunction with the accompanying drawings.

DESCRIPTION OF A PREFERRED EMBODIMENT

Figure 1:
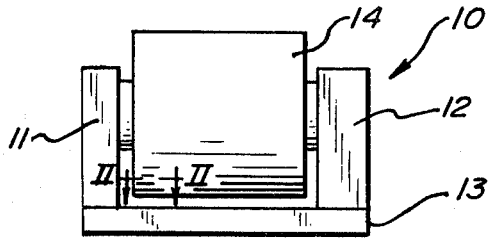
FIG. 1 is a side elevational view illustrating diagrammatically a grinding mill which includes a contact element support arrangement of the invention.

In FIG. 1, reference numeral 10 generally designates a grinding mill which includes a contact element support arrangement constructed in accordance with the principles of this invention. The grinding mill 10 includes a pair of structures 11 and 12 upstanding from a base 13 and including means for journalling and rotating a hollow cylindrical shell or casing 14 disposed therebetween. Material to be ground is supplied into the shell 14 which may have balls or rods disposed therewithin adapted to break up and grind the material as the drum 14 is rotated. Suitable means are provided for supplying the material to the drum 14 and withdrawing the material therefrom.

Figure 2:
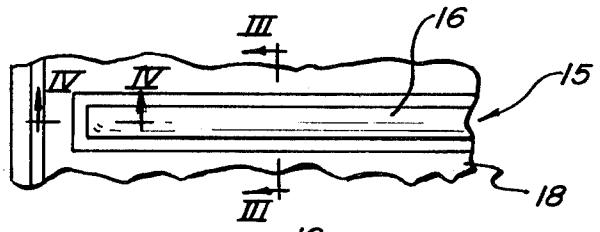
FIG. 2 is a sectional view taken substantially along line II—II of FIG. 1 and on an enlarged scale providing a plan view of a fragmental portion of the support of a contact element.

FIG. 2 is a sectional view which is a plan view showing a fragmental portion of the support of a contact element 15 on the inside of the shell 14. The contact element 15 has an upper surface 16 for contact with the material being treated, it being here noted that terms such as "upper", "lower" and the like are used herein to facilitate description and are not to be construed as limiting the structure to use in any particular position or orientation.

The surface 16 of contact element 15 should resist wear and the element 15 may preferably be of a manganese steel alloy having work-hardening properties such that it becomes harder as it is impacted and stressed, the surface 16 being caused during operation to become very much harder than the main body of the element. In this respect, the life of the elements is prolonged but eventually they wear out and must be replaced. Thus, the support arrangement for the element 15 should allow ready installation and removal of the element and it has been found that the support should have other properties to obtain important advantages as hereinafter explained.

The support arrangement of this invention is relatively simple and facilitates installation of the contact element while providing firm, secure and reliable support thereof. A support element 18 is formed to provide a socket 19 in its upper face into which a lower base portion 20 of the element 15 is inserted. After insertion of the base portion 20 into the socket 19, one or more spaces are provided between surface areas of the contact and support elements 15 and 18 into which a liquid, hardenable plastic material is flowed and allowed to become hardened so as to provide a solid resilient holding and locking element generally designated by reference numeral 21.

With this arrangement, a mechanical lock is provided such that the element 15 cannot be separated from the support element 18 without rupturing or destroying the plastic holding and locking element 21. No adhesive bond is relied upon to insure against separation of the elements. However, the plastic material is preferably such that it does provide an adhesive bond to the engaged surface areas of the elements to minimize the possibility of having the element 15 become loosened. It is desirable in grinding mills and in many of the applications to prevent any free movement of the element 15 relative to the support element 18, even to a very limited extent, and the adhesive bond is highly desirable in this respect. It is noteworthy that with proper configuration of the surface areas involved, undue stresses on the adhesive bond can be obviated so as to minimize the possibility of any rupture in the bond.

In the illustrated arrangement, the element 21 includes a portion 22 disposed between a first surface area 23 on the element 15 and a second surface area 24 on the support element 18, such surface areas being operative to apply compressive forces to the portion 22 when the contact element 15 is moved upwardly away from its installed position. On the opposite side, the element 21 includes a portion 26 disposed between a third surface area 27 on the element 15 and a force area 28 on the support element 18, such surface areas being also operative to apply compressive forces to the portion 26 when the element 15 is moved away from its installed position.

In addition, the holding and locking element 22 includes a portion 30 engaged between a downwardly-facing surface area 31 on the lower face of the element 15 and an upwardly-facing area 32 of the element 18, defining the floor of the socket 19. The portions 22 and 26 are compressed in response to upward movement of the element 15 while the portion 30 is compressed in response to downward movement. Thus, the element 21, acting in compression resiliently opposes movements in both directions.

Figure 3:
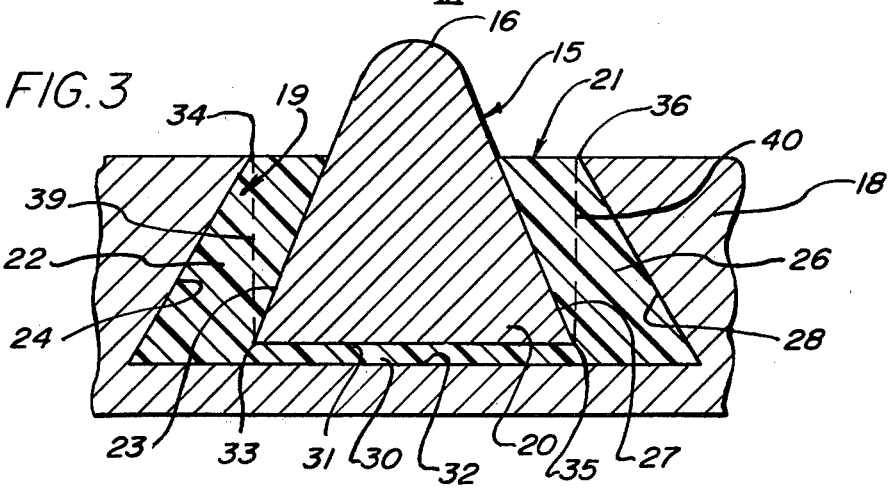
FIG. 3 is a sectional view, on a further enlarged scale, taken substantially along line III—III of FIG. 2.

It is also noted that relative tilting movement of the contact element 15 is also resiliently opposed through compression of the element 21. For example, when the upper end of the element 15 is tilted to the left, as viewed in FIG. 3, the portion 22 is compressed toward the upper end thereof while the portion 26 is compressed toward the lower end thereof and the portion 30 may also be compressed toward the left-hand end thereof.

When the lower base portion 20 of the element 15 is inserted into the socket 19, a lower edge 33 of the surface area 23 passes through an entrance position in which it is opposite one edge 34 of the surface area 24 of the element 18. The edge 33 in such an entrance position is in very close proximity to the edge 34 with, at most, on a small clearance distance therebetween. Similarly, a lower edge 35 of the surface 27 passes through an entrance position in close proximity to an upper edge 36 of the surface area 28. With the configuration as illustrated, the surface area 23, in the installed position of element 15, extends angularly away from a path extending from edge 33 to edge 34, indicated by a dotted line 39, and the surface area 24 extends angularly downwardly and to the left from the path 39. The surface areas 27 and 28 extend in similar angular relationships to a path from edge 35 to edge 36, indicated by reference numeral 40. The portions 22 and 26 thus have generally trapeziform cross-sectional configurations, being preferably generally rhombic in shape as illustrated.

The close spacings between edges 33, 34 35 and 36 in the entrance positions and the angled relationship of the surfaces 23, 24, 27 and 28 as described are important in achieving maximum strength and are important for another reason in that they result in a resilient support of the element 15 in which the energy applied during impacts to the element 15 are absorbed within the element 21. They are further important in utilizing the capabilities of a plastic material in withstanding compressive forces while minimizing tensile and shearing stresses.

With respect to the angles between the surfaces 23, 24, 27 and 28 and the respective paths 39 and 40, it is noted that the volume of the material in the portions 22 and 26 is increased as such angles are increased, assuming that the paths 39 and 40 have certain lengths, and the amount of material available to absorb the energies of impacts is thus increased. However, if the angles are increased beyond a certain point, excessive shearing stresses may be applied to the element 21. The optimum angles thus depend upon the conditions of operation and the characteristics of the material of the element 21. In general, the angles should be substantial, at least on the order of five to ten degrees and in many applications, they should be on the order of thirty to forty degrees, as illustrated.

It is further desirable that the angles of the surface areas 24 and 28 be somewhat greater than the angles of the surface areas 23 and 24 in order to obtain a wedging action on the portions 22 and 26 when the element 15 is moved upwardly. This action enhances the application of compressive forces to the portions 22 and 26.

It is noted that in the illustrated arrangement, the support of the element 15 is symmetrical, the portions 22 and 26 having the same shape. In certain applications, the portions 22 and 26 may have different shape to provide an asymmetrical construction and in some cases, one portion can be simply eliminated. Thus, for example, the surfaces 27 and 28 might be interengaged with no part of the element 21 therebetween and with angles as illustrated, the paths 39 would extend angularly downwardly to the right. If, under such circumstances, the surfaces 27 and 28 were vertical, the paths 39 would extend vertically as shown, the result being a holding and locking action on the left side only.

Figure 4:
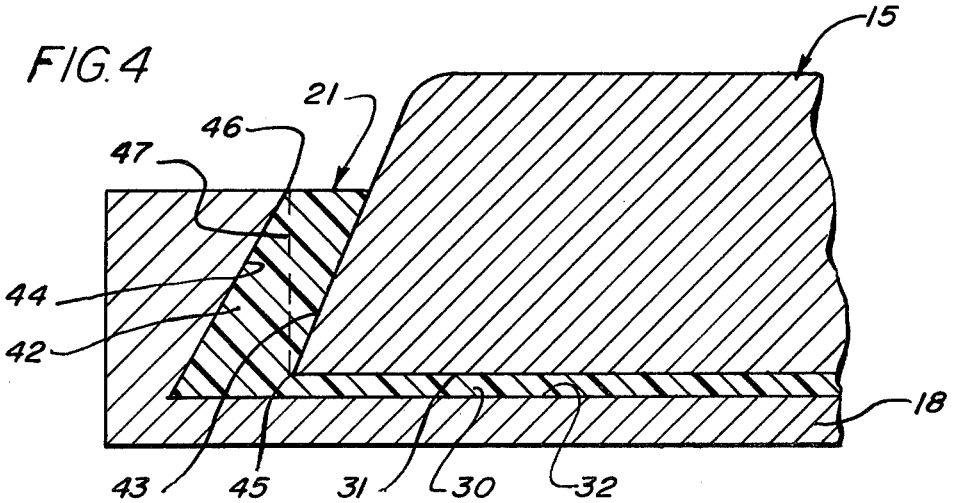
FIG. 4 is a sectional view on the same scale as FIG. 3, taken substantially along line IV—IV of FIG. 2.

FIG. 4 illustrates the construction at one end of the element 15 wherein the holding and locking element 21 includes a portion 42 disposed between surface areas 43 and 44 of the elements 15 and 18, the surface areas 43 and 44 having edges 45 and 46 with a path therebetween being indicated by dotted line 47. The portion 42 operates in a manner similar to the portions 22 and 26 and will be understood that a similar portion is provided at the opposite end of the element 15, not shown. It is noted also that although the illustrated element 15 is elongated, it may have a pyramidal or conical shape, depending upon the type of application. In this connection, it will be understood that the invention can be applied to the support of material contacting elements usable in a variety of applications. The invention is, however, particularly advantageous when applied to the support of contact elements in material-treating applications in which the elements are subjected to severe abuse from high energy impacts and in which there is a severe wear problem, necessitating frequent replacement of the elements.

With respect to replacement of the element 15, the assembly may be heated to a temperature such that the element 21 is effectively burned up, permitting removal of the element 15 and replacement by a new element. The support element 18 may be secured to the shell 14 by suitable bolts or the like and, if desired, may support one or more elements in addition to the illustrated elements of 15.

Many different compositions of hardenable plastic materials are usuable for forming the element 21, the wellknown epoxy resin materials being suitable for the purpose in that they can provide the desirable adhesive bonds to the surfaces of the contact and support elements and, at the same time, provide the desired characteristics with respect to the resiliency and strength of the element 21. It is again noted that through the described configuration of the surfaces, the tensile and shearing stresses imposed upon the material of the element 21 can be minimized and, also, stresses on adhesive bonds to the surface areas are minimized.

It will be understood that modifications and variations may be effected without departing from the spirit and scope of the novel concepts of this invention.

I claim:

1. In a device for treating materials, a metal support element formed to provide a socket in an upper face thereof, a metal contact element disposed in said socket, a first pair of side surfaces being defined by opposite internal side surfaces of said support element within said socket and a second pair of side surfaces being defined by opposite external side surfaces of said contact element, said first and second pairs of side surfaces being positioned to provide a pair of spaces therebetween, and a solid resilient plastic material disposed in said pair of spaces and acting between said first and second pairs of side surfaces to hold said contact element against upward movement out of said socket, said side surfaces being generally planar and at least one of said pair of side surfaces being generally in planes converging upwardly and inwardly to intersect in a line above said socket with upward movement of said contact element relative to said support element being effective to apply compressive forces to said plastic material with minimal development of tensile and shearing stresses in said plastic material.

2. In a device as defined in claim 1, said plastic material being hard after flowing into said spaces.

3. In a device as defined in claim 2, said contact element being dimensioned for insertion downwardly into said socket prior to flowing of said plastic material into said spaces.

4. In a device as defined in claim 2, upper ends of said first pair of side surfaces being spaced apart a distance only slightly greater than the distance between lower ends of said second pair of side surfaces to permit insertion of said contact element into said socket while maximizing the effectiveness of said plastic material in holding said contact element in said socket.

5. In a device as defined in claim 1, said first pair of side surfaces being generally in a first pair of planes and said second pair of side surfaces being generally in a pair of second planes with both of said pairs of planes converging upwardly and inwardly to intersect at lines above said socket.

6. In a device as defined in claim 5, an angle between said first pair of planes being greater than an angle between said second pair of planes.

7. In a device as defined in claim 6, the lines of intersection of said first and second pairs of planes being substantially in a central vertical plane of said socket and said contact element with there being a symmetrical relationship of said first and second pairs of surfaces.

8. In a device as defined in claim 1, said contact element having a bottom surface in spaced relation to an upwardly facing lower surface of said socket, and solid resilient plastic material in the space between said bottom surface of said contact element and said lower surface of said socket.

9. In a device as defined in claim 1, said plastic material being hardened after being flowed into said spaces and being adhesively bonded to said first and second pairs of surfaces.

10. In a device for treating materials, a metal support element formed to provide a socket in an upper face thereof, a metal contact element inserted downwardly into said socket, a first pair of side surfaces being defined by opposite internal side surfaces of said support element within said socket and a second pair of side surfaces being defined by opposite external side surfaces of said contact element, said first and second pairs of side surfaces being positioned to provide a pair of spaces therebetween, and plastic material being after flowing into said spaces to provide a solid resilient plastic material acting between said first and second pairs of side surfaces to hold said contact element against upward movement out of said socket, said first pair of side surfaces being generally in a first pair of planes and said second pair of side surfaces being generally in a second pair of planes with both of said pairs of planes converging upwardly and inwardly to intersect at lines above said socket, and upper ends of said first pair of side surfaces being spaced apart a distance only slightly greater than the distance between lower ends of said second pair of side surfaces to permit insertion of said contact element into said socket while maximizing the effectiveness of said plastic material in holding said contact element in said socket.

11. In a device as defined in claim 10, an angle between said first pair of planes being greater than an angle between said second pair of planes.

12. In a device as defined in claim 11, said contact element having a bottom surface in spaced relation to an upwardly facing lower surface of said socket, and said plastic material being disposed in the space between said bottom surface of said contact element and said lower surface of said socket.

* * * * *

UNITED STATES PATENT AND TRADEMARK OFFICE

CERTIFICATE OF CORRECTION

PATENT NO. : 4,341,355

DATED : July 27, 1982

INVENTOR(S) : MICHAEL E. HORNBERGER

It is certified that error appears in the above-identified patent and that said Letters Patent are hereby corrected as shown below:

Column 5, line 56 "wellknown" should be -- well-known --.

Column 7, line 1 (Claim 10), after "being", insert -- hard --.

Signed and Sealed this

*Fifth* Day of *October 1982*

[SEAL]

*Attest:*

GERALD J. MOSSINGHOFF

*Attesting Officer*

*Commissioner of Patents and Trademarks*